US009062863B2

(12) United States Patent
Ng et al.

(10) Patent No.: US 9,062,863 B2
(45) Date of Patent: Jun. 23, 2015

(54) SYSTEM, DEVICE, AND METHOD FOR ADJUSTING COLOR OUTPUT THROUGH ACTIVE COOLING MECHANISM

(71) Applicant: Avago Technologies General IP (Singapore) Pte. Ltd., Singapore (SG)

(72) Inventors: Keat Chuan Ng, Penang (MY); Kheng Leng Tan, Penang (MY); Ju Chin Poh, Penang (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 268 days.

(21) Appl. No.: 13/710,440

(22) Filed: Dec. 10, 2012

(65) Prior Publication Data

US 2014/0160746 A1 Jun. 12, 2014

(51) Int. Cl.

| | |
|---|---|
| ***F21V 29/00*** | (2006.01) |
| ***F21V 9/00*** | (2006.01) |
| ***F21V 5/04*** | (2006.01) |
| ***F21S 8/00*** | (2006.01) |
| ***F21V 14/06*** | (2006.01) |
| ***F21V 14/08*** | (2006.01) |
| *F21Y 101/02* | (2006.01) |

(52) U.S. Cl.

CPC ..... *F21V 29/002* (2013.01); *F21V 5/04* (2013.01); *F21V 9/00* (2013.01); *F21V 29/40* (2013.01); *F21S 8/03* (2013.01); *F21V 14/06* (2013.01); *F21V 14/08* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 7,300,173 | B2 * | 11/2007 | Catalano et al. | 362/208 |
| 2005/0225985 | A1 * | 10/2005 | Catalano et al. | 362/277 |
| 2010/0207502 | A1 | 8/2010 | Cao et al. | |
| 2010/0314985 | A1 | 12/2010 | Premysler | |
| 2011/0215345 | A1 | 9/2011 | Tarsa et al. | |
| 2011/0298371 | A1 | 12/2011 | Brandes et al. | |

OTHER PUBLICATIONS

Pohl, Andreas, "Dawn of neutral white LEDs in street lighting", available at http://www.ecnmag.com/articles/2012/04/dawn-neutral-white-leds-street-lighting, Avago Technologies Germany, ECN Magazine, Apr. 20, 2012, 7 pages.

* cited by examiner

*Primary Examiner* — Ashok Patel

(57) ABSTRACT

An illumination device, system, and method are disclosed. The illumination device includes an active cooling mechanism and a controller for the same. When the controller activates or deactivates the active cooling mechanism, one or more optical elements on the illumination device are automatically moved, thereby adjusting at least one characteristic of the light emitted by the illumination device.

20 Claims, 7 Drawing Sheets

SYSTEM, DEVICE, AND METHOD FOR ADJUSTING COLOR OUTPUT THROUGH ACTIVE COOLING MECHANISM

FIELD OF THE DISCLOSURE

The present disclosure is generally directed toward light emitting devices and particularly toward adjustable light emitting devices.

BACKGROUND

Light Emitting Diodes (LEDs) have many advantages over conventional light sources, such as incandescent, halogen and fluorescent lamps. These advantages include longer operating life, lower power consumption, and smaller size. Consequently, conventional light sources are increasingly being replaced with LEDs in traditional lighting applications. As an example, LEDs are currently being used in flashlights, camera flashes, traffic signal lights, automotive taillights and display devices. LEDs have also gained favor in residential, industrial, and retail lighting applications.

It is relatively straight-forward to provide a lighting fixture which emits a single color of light. If a multi-colored lighting fixture is desired, however, at least an electronic controller and multiple different types of light sources are required. It is also customary to include multiple power supply drivers—one for each different type of light sources. As can be appreciated, this greatly increases the costs of achieving multi-colored lighting from a single lighting fixture. Moreover, if space is limited, the achievement of multiple colors is often done at the expense of brightness.

SUMMARY

It is, therefore, one aspect of the present disclosure to provide an illumination system, device, and method that overcome the above-noted issues. Specifically, embodiments of the present disclosure provide an illumination device that is capable of producing multiple colors without significantly increasing the costs of the illumination device as compared to a single color illumination device. Even more specifically, an illumination device is disclosed that comprises an active cooling mechanism. The active cooling mechanism comprises the ability to generate wind or pressure differentials that can be leveraged to adjust the color of light output by the illumination device.

In some embodiments, the wind or pressure generated by the active cooling mechanism may exert a force that ultimately results in a movable cover moving from a first position to a second position. While the movable cover is in the first position, the illumination device emits light of a first type (e.g., first color). While the movable cover is in the second position, the illumination device emits lights of a second type (e.g., second color).

The movable cover, in some embodiments, moves as a direct result of the forces exerted by the active cooling mechanism. In some embodiments, the movable cover moves under the influence of a different mechanism, such as a wind catch, because the movable cover is physically coupled to the wind catch.

The difference in light emitted by the illumination device can be realized because the movable cover may, in some embodiments, comprise one or more properties that cause the movable cover to covert light that passes therethrough. Accordingly, when the movable cover is in a first position it may be converting light; however, when the movable cover is in the second position it may be allowing some light to leave the illumination device without any substantial conversion.

The present disclosure will be further understood from the drawings and the following detailed description. Although this description sets forth specific details, it is understood that certain embodiments of the invention may be practiced without these specific details. It is also understood that in some instances, well-known circuits, components and techniques have not been shown in detail in order to avoid obscuring the understanding of the invention.

BRIEF DESCRIPTION OF THE DRAWINGS

The present disclosure is described in conjunction with the appended figures.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Figure 1:
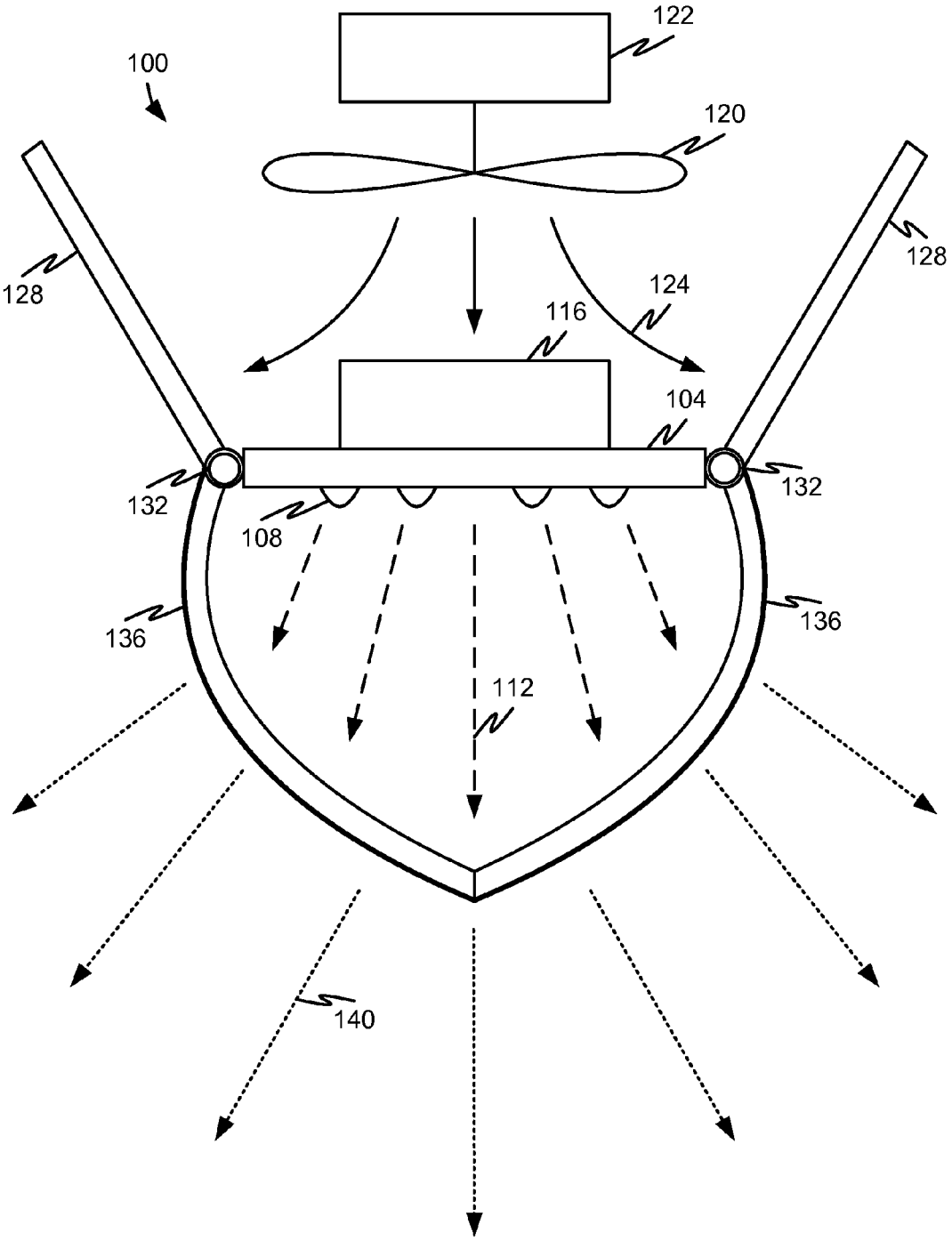
FIG. 1 is a cross-sectional view of a first illumination device in a first configuration in accordance with embodiments of the present disclosure.
Figure 2:
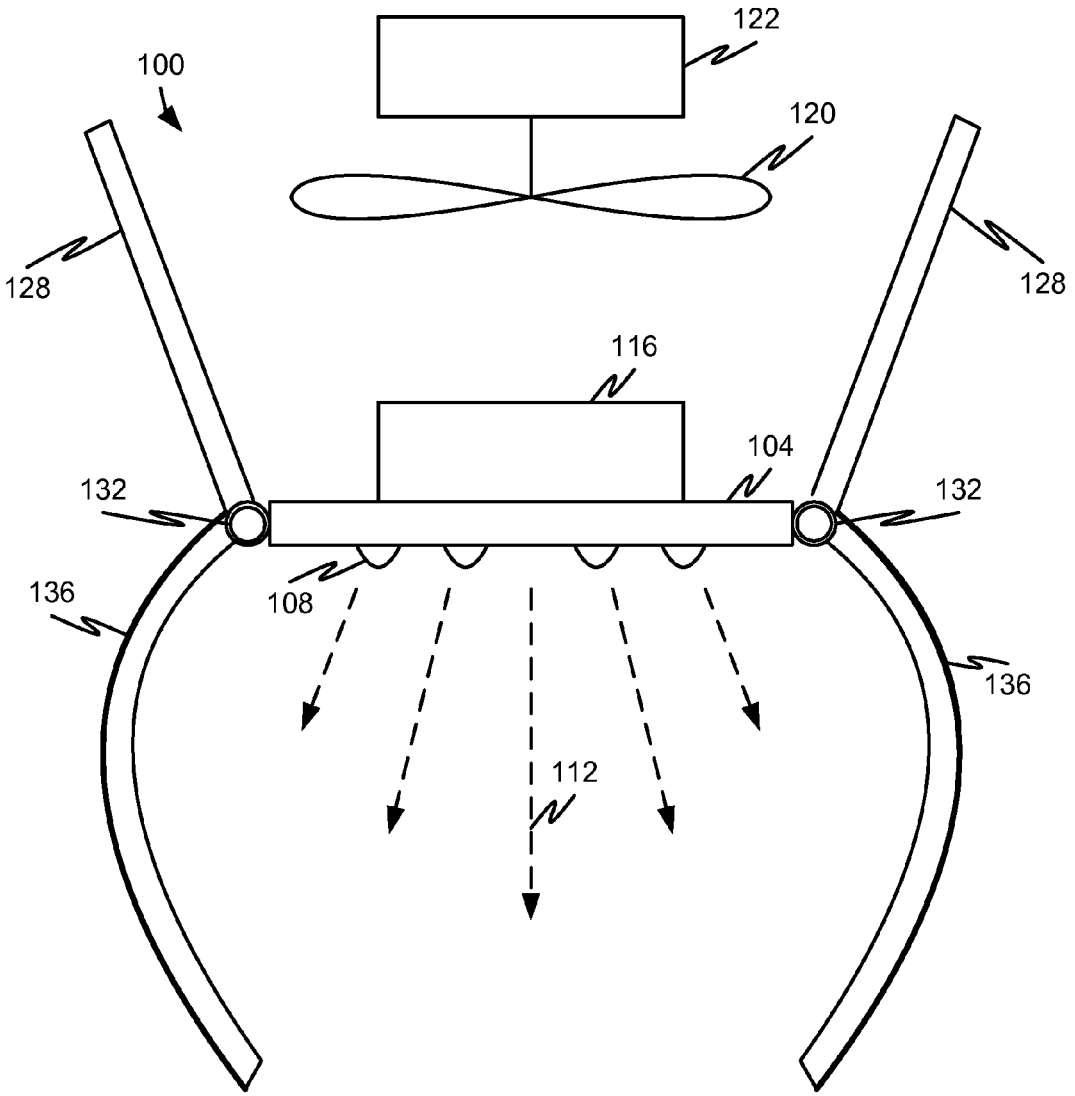
FIG. 2 is a cross-sectional view of the first illumination device in a second configuration in accordance with embodiments of the present disclosure.

With reference now to FIGS. 1 and 2, an illustrative illumination device 100 is depicted in accordance with at least some embodiments of the present disclosure. The depicted illumination device 100 corresponds to a particular configuration of illumination device. It should be appreciated, however, that embodiments of the present disclosure are not limited to the specific configuration of illumination device 100 depicted. Rather, embodiments of the present disclosure may be applied to any type of illumination device or collection of illumination devices such as tube lighting, flood lighting, track lighting, chandeliers, fan lights, pendant lighting, recessed or can lighting, etc.

The illumination device 100 is depicted as including a substrate 104 with one or more light sources 108 mounted thereon. The substrate 104 also comprises a power source 116 or other source of heat. Because the power source 116 inherently produces heat during operation (e.g., while providing power or driving the light sources 108), the illumination device 100 is further depicted as including an active cooling element 120 that is controlled/operated by a controller 122. When the controller 122 causes the active cooling element 120 to be in an operational or ON state, the active cooling element 120 produces wind 124. In some embodiments, the wind 124 produced by the active cooling element 120 provides two functions: (1) cooling the power source 116 and (2) exerting a force on one or more wind catches 128.

The cooling function of the active cooling element 120 is especially useful for illumination devices that employ one or more light sources 108 which inherently generate a significant amount of heat in addition to the heat generated by their power supply 116. The force-exertion function helps to control the position of one or more movable covers 136 vis-à-vis the wind catches 128.

More specifically, embodiments of the present disclosure contemplate that a wind catch 128 can be physically or mechanically coupled to one or more movable covers 136. In the depicted embodiment, the movable covers 136 are substantially rigid as are the wind catches 128. Each movable cover 136 is physically or mechanically coupled to a wind catch 128 via a pivot element 132. The pivot element 132 allows the movement of the wind catch 128 to be translated to movement of the movable cover 136. As can be seen by the comparison of FIG. 1 with FIG. 2, when the active cooling element 120 is in an ON state, the forces exerted by the wind 124 on the wind catches 128 bias the wind catches 128 outward—this may correspond to a first position of the wind catches 128. While the wind catches 128 are being biased toward their outward position, the movable covers 136 coupled thereto are biased inwardly—this may correspond to a first position of the movable covers 136. In a specific embodiment, the pivot element 132 may correspond to a spring that exerts a minimal predetermined force that biases the wind catch 128 inward (to its second position) and the movable cover 136 outward (to its second position). The forces created by the wind 124 are sufficient to overcome the biasing force of the spring and, therefore, causes the wind catch 128 and movable cover 136 to move to their first position.

While in the first position, each movable cover 136 is configured to intercept emitted light 112 that is emitted by the light sources 108 prior to the light leaving the illumination device. In some embodiments, each movable cover 136 may comprise or be treated with an optical element or material that alters or converts the emitted light 112 into converted light 140. As a non-limiting example, the movable cover 136 may comprise one or more of a phosphor coating, a phosphor material, a diffuser element, a lens element, a mirror, or combinations thereof.

FIG. 2 shows that when the active cooling element 120 is inactive or in an OFF state, there is no longer any substantial amount of wind 124 forces exerted on the wind catches 128. This causes the wind catches 128 and the movable covers 136 to move to a second position. It should be appreciated the configuration of FIG. 2 may occur whenever the active cooling element 120 does not create enough force to overcome the biasing of the wind catches 128. For instance, the wind catches 128 and movable covers 136 may be in their second position even when the active cooling element 120 is in an ON, but LOW state such that wind 124 forces are insufficient to overcome any forces biasing the wind catches 128 and movable covers 136 to their second position (e.g., spring biasing forces, inertial forces, etc.).

As can be seen in FIG. 2, when the movable covers 136 are in the second position, the emitted light 112 has at least one path by which it can exit the illumination device 100 without having to pass through the movable covers 136. This means that some light can be emitted by the illumination device 100 as non-converted light. Of course, some emitted light 112 may still pass through the movable covers 136 where it can be converted into converted light 140.

In some embodiments, the light source(s) 108 and active cooling element 120 may receive their control inputs from a common controller (e.g., controller 122). More specifically, it may be possible to configure the controller 122 to receive user inputs that can be translated to multiple outputs—a first output to the light source(s) and a second output to the active cooling element 120. When an input is received at the controller 122 to dim the light source(s) 108, for example, the controller may generate two output signals—a first of the output signals being directed to the light source(s) 108 to cause the light source(s) 108 to dim and a second of the output signals being directed to the active cooling element 120 to cause the active cooling element to slow down or go into a LOW state of operation. Alternatively, when an input is received at the controller 122 to switch the light source(s) 108 to maximum brightness, the controller 122 may instruct the light source(s) to emit light at a maximum brightness in addition to instructing the active cooling element 120 to operate at full speed. One advantage of such a configuration is that when the light source(s) 108 is dimmed down, it do not generate as much heat, so the active cooling element 120 could also slow down without affecting the heat dissipation of the overall illumination device 100.

Referring back to the individual components of the illumination device 100, the substrate 104 is depicted as being a generally planar substrate onto which one or more light sources 108 are mounted. Specifically, the substrate 104 is depicted as having a major bottom surface and an opposing major top surface. The one or more light sources 108 are mounted on the major bottom surface while the major top surface support the power source 116. It should be appreciated that other possible configurations of the substrate 104, light sources 108, and power source 116 can be accommodated.

In some embodiments, the substrate 104 corresponds to a generally planar and rigid substrate, such as a rigid Printed Circuit Board (PCB). In some embodiments, the substrate 104 corresponds to a flexible material, such as a flexible PCB. It should also be appreciated that the substrate 104 may comprise multiple layers of materials without departing from the scope of the present disclosure. Moreover, the substrate 104 may also comprise a heat-sink element, such as aluminum or some other alloy that dissipates heat away from the light sources 108 toward the major top surface so that the heat can be further dissipated by the active cooling element 120.

Any type of known light-emitting device may be used for the light sources 108. As some non-limiting examples, the light source(s) 108 may correspond to an LED, an array of LEDs, a laser diode, an array of laser diodes, or the like. In some embodiments, a plurality of LEDs may be configured to emit light when a voltage difference is applied across the anode and cathode of the LEDs (e.g., current is provided to the LEDs). In some embodiments, the light source(s) 108 may comprise a thru-hole mount LED and/or surface mount LED. Another type of light source 108 that may be employed in accordance with embodiments of the present disclosure is an Organic LED (OLED) sheet or film.

The light source(s) 108 may be activated/deactivated under the control of the power source 116. In some embodiments, the power source 116 comprises a simple power converter that accepts AC power (e.g., conventional grid-based AC power, such as 120V, 60 hz) as an input and conditions the power such that it can be used to drive the light sources 108. Alternatively or additionally, the power source 116 may correspond to a DC power source, such as one or more batteries.

In some embodiments, the power source 116 may also comprise logic used to determine whether and when the light sources 108 should be activated/deactivated. Alternatively or additionally, the power source 116 may comprise a heat-sink element that helps dissipate heat away from the heat-sensitive components of the power source 116.

The active cooling element 120 may correspond to any type of device capable of actively cooling one or more components of the illumination device 100. As some examples, the active cooling element 120 may correspond to a fan or propeller having one or more blades that rotate about a rotation point. When activated by the controller 122, the blades of the active cooling element 120 may generate wind 124. Another type of suitable active cooling element 120 is an external source of gas or air (compressed or uncompressed). Yet another type of suitable active cooling element 120 is a piston or plunger that pushes air toward the wind catches 128. Said another way, any type of device or collection of devices that is capable of facilitating heat transfer in addition to creating a force or pressure on the wind catch 128 can be used as part of the active cooling element 120.

The pivot element 132 may correspond to any device or collection of devices that couples the wind catch 128 to the movable cover 136. In some embodiments, a simple hinge or the like may be used as the pivot element 132. In some embodiments, the pivot element 132 may comprise a spring that biases the wind catch 128 and/or movable cover 136 into a predetermined position and when a sufficient amount of force is applied to the wind catch 128 via wind 124, the biasing force of the spring in the pivot element 132 may be overcome.

The embodiment depicted in FIGS. 1 and 2 show a pivot element 132 that couples a substantially rigid movable cover 136 to a rigid wind catch 128. As an example, these components, as well as any other component of the illumination device 100, may be manufactured of any type of known polymer, composite, metal, wood, ceramic, glass, or combinations thereof. Thus, the movable cover 136 may or may not correspond to a rigid element. Similarly, the wind catch 128 may or may not be rigid and the movement imparted on the movable cover 136 via the wind catch 128 does not necessarily have to be rotational. Specifically, any translational movement of the movable cover 136 may also be utilized without departing from the scope of the present disclosure.

Figure 3:
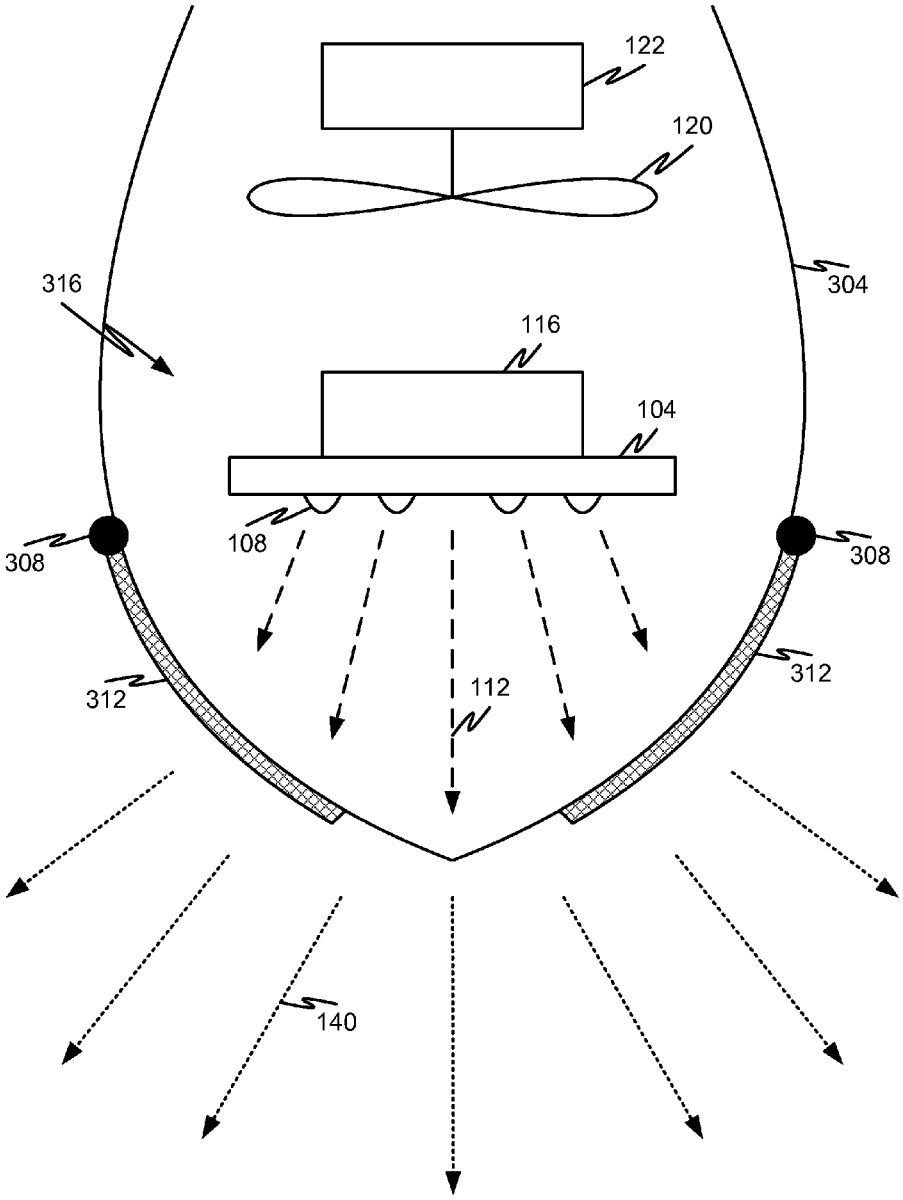
FIG. 3 is a cross-sectional view of a second illumination device in a first configuration in accordance with embodiments of the present disclosure.
Figure 4:
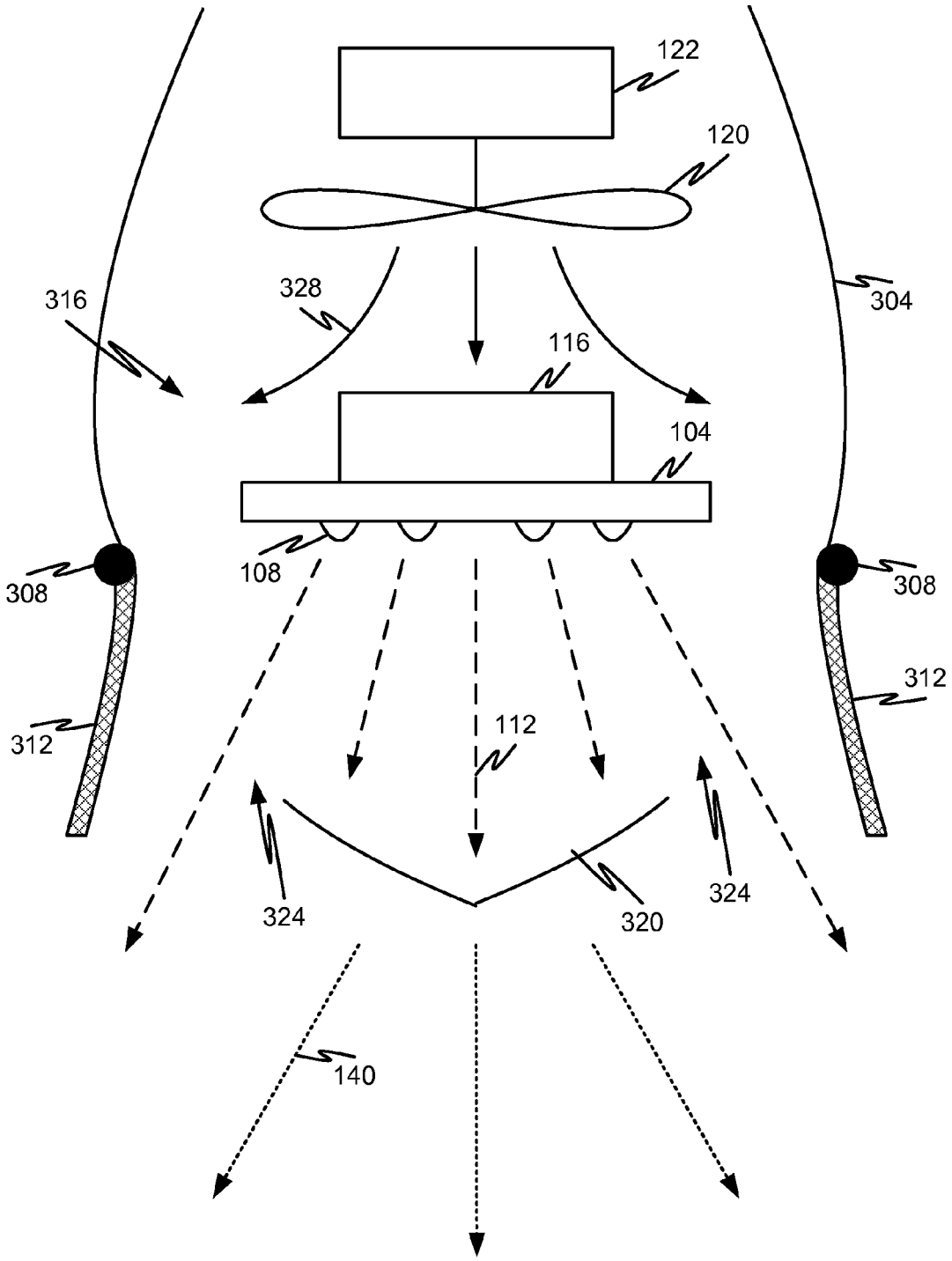
FIG. 4 is a cross-sectional view of the second illumination device in a second configuration in accordance with embodiments of the present disclosure.

With reference now to FIGS. 3-4, another configuration of illumination device will be discussed in accordance with embodiments of the present disclosure. This particular configuration of illumination device is similar to the previously-discussed configuration except that the illumination device comprises a shell 304 that establishes an inner cavity 316. Additionally, the illumination device of FIGS. 3-4 exhibits a movable cover 312 that is flexible or non-rigid. In this particular configuration, the need for a separate wind catch may not be necessary. Rather, forces created by wind 328 within the inner cavity 316 may cause the movable covers 312 to move away from their biased position of rest.

In accordance with at least some embodiments, the movable covers 312 may correspond to a flexible material that is capable of deforming or moving under direct forces applied by the wind 328. The movable covers 312 may still rotate or move about a pivot element 308 that is connected to or part of the shell 304. It should be appreciated that the nature of the pivot element 308 may vary depending upon whether the movable cover 312 is flexible or rigid. Specifically, where the movable cover is flexible, then it may be possible to utilize a pivot element 308 that does not necessarily move or rotate. Rather, the pivot element 308 may correspond to a simple connection (e.g., weld, tape, glue, bond, mechanical-fit, etc.) between the movable cover 312 and the shell 304. When the movable cover is inflexible or rigid, then it may be necessary to employ a pivot element 308 that facilitates at least some rotational movement (e.g., a hinge and/or spring).

When the wind 328 created by the active cooling element 120 causes the movable covers 312 to move, then one or more openings or windows 324 in the shell 304 may be exposed. When the windows 324 are opened, then at least some emitted light 112 may be allowed to leave the shell 304 without being converted by the movable covers 312. Of course, other emitted light 112 may pass through the movable covers 312 or through other portions of the shell 304, such as a lower portion 320 of the shell 304. However, when the windows 324 are closed due to the lack of appropriate wind forces in the inner cavity 316, then the emitted light 312 either has to pass through the movable covers 312 or through other portions of the shell 304 such that all of the emitted light 112 is eventually converted into converted light 140.

As a non-limiting example, the shell 304 may correspond to a glass or plastic shell that substantially covers or surrounds the light sources 108. The shell 304 may, for instance, correspond to a shell of pendant lighting, track lighting, a downlight, etc. Some portions of the shell may be transparent or translucent. The movable covers 312, in some embodiments, may be configured to convert the emitted light 112 differently than the rest of the shell 304. For instance, the movable covers 312 may comprise silicone, phosphor, a hybrid of silicone and phosphor, dyes, lenses (e.g., Fresnel lenses), diffusing elements, or any other material that changes the appearance of the emitted light 112. Accordingly, the light emitted by the illumination device 100 may exhibit a first characteristic when the movable covers 312 are closed whereas the light emitted by the illumination device 100 may exhibit a second characteristic when the movable covers 312 are opened.

The embodiment of FIGS. 3 and 4 is interesting because the movable covers 312 are capable of being moved under the direct influence of forces exerted by the wind 328 rather than being moved by some other mechanism, such as wind catch 128. This simplifies the illumination device 100 and may provide for a lower-profile and more elegant solution to alter lighting characteristics in response to the activation/deactivation of the active cooling element 120.

Figure 5:
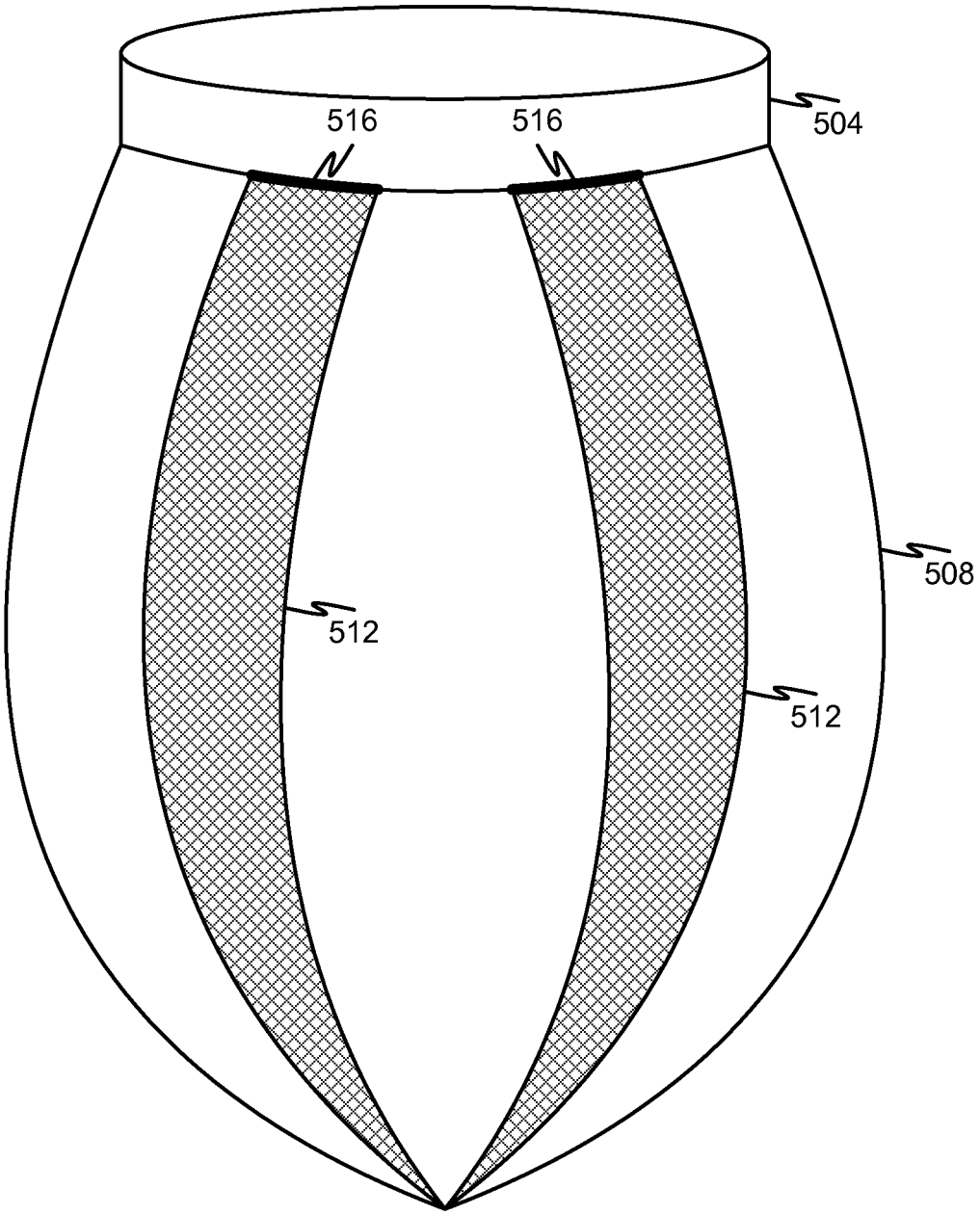
FIG. 5 is an isometric view of a third illumination device in accordance with embodiments of the present disclosure.

With reference now to FIG. 5, another example of an illumination device is depicted in accordance with at least some embodiments of the present disclosure. The illumination device of FIG. 5 may have some or all of the features of the illumination devices shown in any of FIGS. 1-4. Similarly, any of the illumination devices of FIGS. 1-4 may be enhanced with one or more features of the illumination device depicted in FIG. 5.

In some embodiments, the illumination device may include a shell 508 having an upper portion 504 and a lower portion. The upper portion of the shell 504 may correspond to an interface through which the illumination device may be attached to a lighting fixture or mount, for example. More specifically, the upper portion of the shell 504 may comprise one or more threads that enable the illumination device to be physically inserted into a lighting fixture. Alternatively or additionally, the upper portion of the shell 504 may provide an electrical interface between the illumination device and an external AC power source. Specifically, the upper portion of the shell 504 may be made of a conductive material (e.g., metal, aluminum, copper, brass, etc.), which allows the illumination device to receive power from an external source.

As with the other illumination devices, the illumination device of FIG. 5 is depicted as including one or more movable covers 512 that are connected to the shell 508 via a pivot element 516. In this embodiment, the movable covers 512 extend along the entire length of the shell 508. As can be appreciated, the size and dimensions of the movable covers 512 may be adjusted to accommodate any type of desired lighting behavior. The size of the movable covers 512, the materials used to construct the movable covers 512, and other variables described in connection with the movable covers can be adjusted depending upon the lighting effects desired of the illumination device. Moreover, the nature of the pivot element 516 may depend upon the type of movable cover 512 being used (e.g., depend upon whether the movable cover 512 is rigid or flexible).

Figure 6:
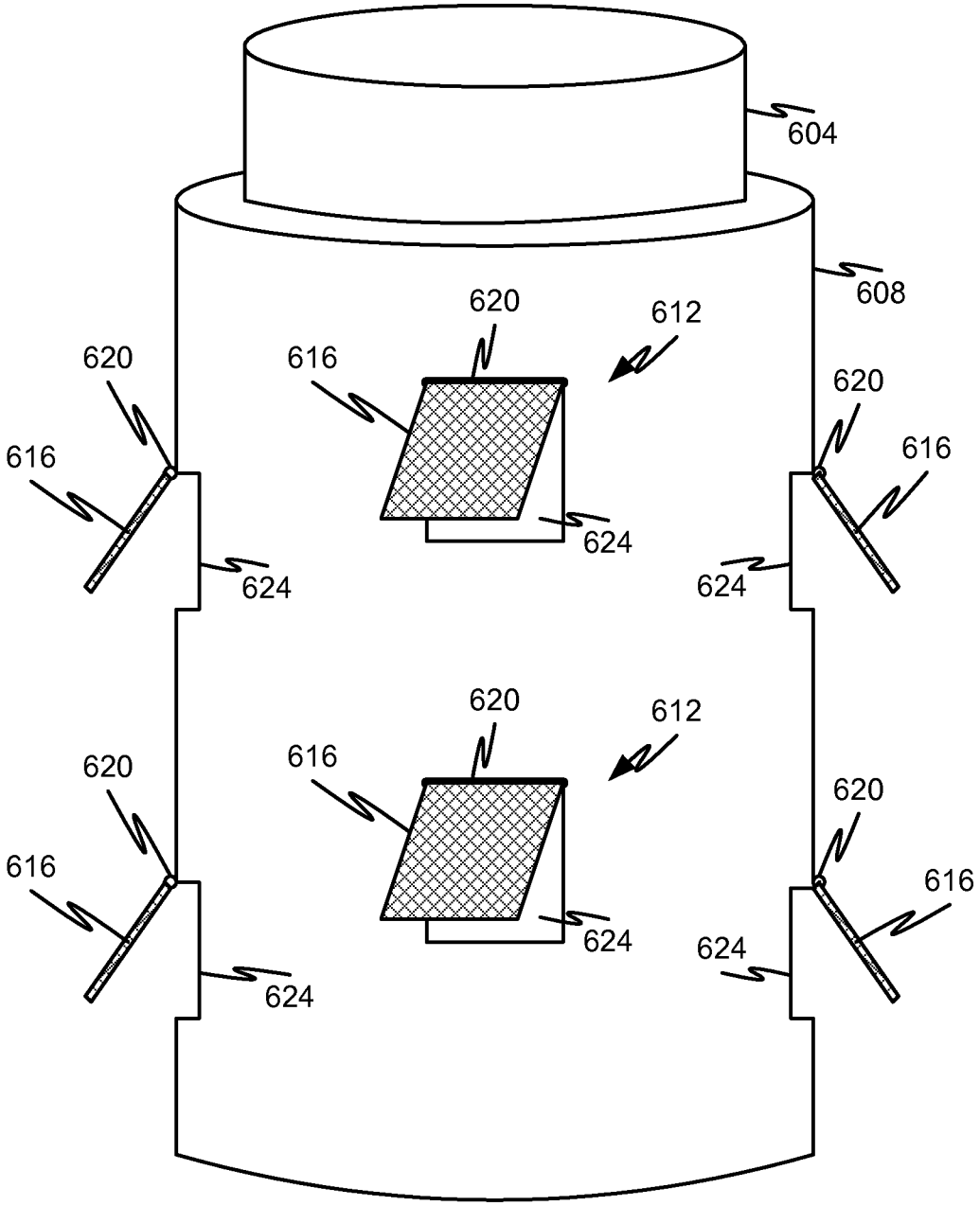
FIG. 6 is an isometric view of a fourth illumination device in accordance with embodiments of the present disclosure.

FIG. 6 depicts yet another possible illumination device that may be used in accordance with at least some embodiments of the present disclosure. The illumination device of FIG. 6 may have some or all of the features of the illumination devices shown in any of FIGS. 1-5. Similarly, any of the illumination devices of FIGS. 1-5 may be enhanced with one or more features of the illumination device depicted in FIG. 6.

In some embodiments, the illumination device comprises a cylindrical or tube-like shape rather than a pendant or tear drop-like shape. The illumination device still comprises a shell having an upper portion 604 and a lower portion 608. The upper portion of the shell 604 may be similar or identical to the upper portion of shell 504 depicted in FIG. 5.

The bottom portion of the shell 608 may comprise a generally cylindrical shape having one or more light converters 612 established thereon. Each light converter 612 may comprise a movable cover 616, a pivot element 620, and a window 624. The movable cover 616 of each light converter 612 may be moved between a first position and second position under forces created by an active cooling element, for example. While the movable covers 616 are in their first position, the windows 624 may be closed—this may correspond to a state where the active cooling element of the illumination device is either in an OFF state or in a LOW state where wind-based forces are insufficient to move the movable covers 616. While the movable covers 616 are in their second position, the windows 624 may be opened—this may correspond to a state where the active cooling element of the illumination device is in an ON state where wind-based forces are sufficient to move or displace the movable covers 616. When the movable covers 616 are in their second position, the windows 624 may be opened and at least some light may be emitted by the illumination device without being converted by the movable covers 616.

Figure 7:
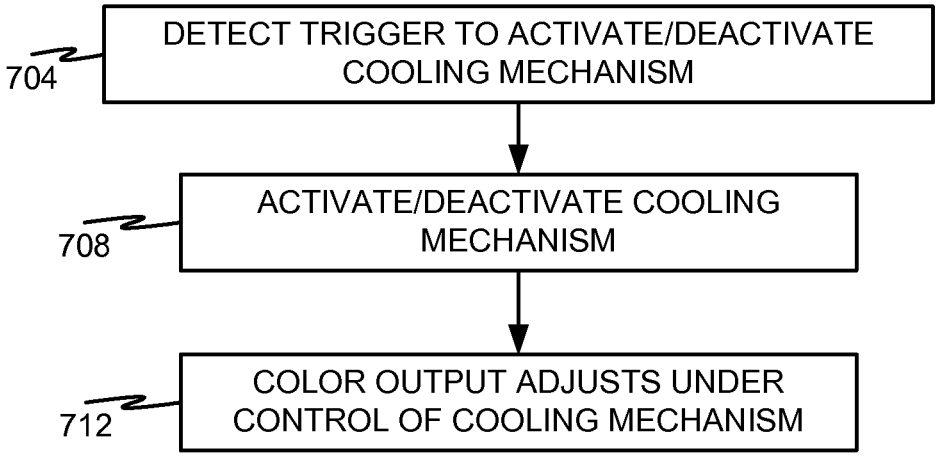
FIG. 7 is a flow chart depicting an illumination method in accordance with embodiments of the present disclosure.

With reference now to FIG. 7, an illumination method will be described in accordance with at least some embodiments of the present disclosure. The method begins when a controller 122 of an active cooling element 120 detects a trigger to activate or deactivate the active cooling element 120 (step 704). This trigger may correspond to the detection of a single indicating that a user wants to dim or change the color of light emitted by the illumination device. Alternatively or additionally, the trigger may correspond to the detection of an overheating condition that dictates the active cooling element 120 should be activated. Alternatively or additionally, the trigger may correspond to the detection of a condition indicating that the active cooling element 120 can be turned off (e.g., due to the absence of an overheating condition).

Upon detecting the trigger, the controller 122 activates or deactivates the active cooling element 120 as appropriate (step 708). When the active cooling element 120 is activated or deactivated (e.g., the wind forces being generated by the active cooling element 120 change), the characteristics of light emitted by the illumination device may be automatically adjusted (step 712). In some embodiments, the activation/deactivation of the active cooling element 120 may cause one or more movable covers to move from a first position to a second position, thereby causing the color of light emitted by the illumination device to change. In some embodiments, the movable covers may change something other than the color of light emitted by the illumination device (e.g., color intensity, brightness, dispersion, color, direction, or combinations thereof).

Of course, the controller 122 does not necessarily have to move the active cooling element 120 between ON and OFF states. Rather, the controller 122 can adjust the speed of the active cooling element 120 incrementally as any fraction of its maximum speed, thereby changing the position of the movable covers between an infinite number of possible positions. Each of the multiple positions between fully opened and fully closed may have a different affect on the way in which emitted light is converted, thereby changing the characteristics of light emitted by the illumination device.

Specific details were given in the description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. An adjustable illumination device, comprising:

one or more light sources configured to emit light;

an active cooling element;

a controller electrically connected to the active cooling element and configured to control an operational state of the active cooling element with one or more electrical signals; and a movable cover moveable between a first position and a second position depending upon the operational state of the active cooling element, wherein the movable cover alters at least one characteristic of light emitted by the one or more light sources.

2. The device of claim 1, further comprising:

a pivot element coupled to the movable cover, the pivot element enabling the movable cover to pivot between the first position and the second position.

3. The device of claim 2, wherein the pivot element comprises at least one of a hinge and spring.

4. The device of claim 3, wherein the pivot element imparts a biasing force on the movable cover and wherein the active cooling element creates a force during an ON state that is sufficient to overcome the biasing force and cause the movable cover to move from the first position to the second position.

5. The device of claim 4, wherein the first position corresponds to a position where the movable cover alters a first amount of light emitted by the one or more light sources, wherein the second position corresponds to a position where the movable cover alters a second amount of light emitted by the one or more light sources.

6. The device of claim 1, wherein the movable cover is flexible.

7. The device of claim 1, wherein the movable cover alters a color of the light emitted by the one or more light sources.

8. The device of claim 1, wherein the movable cover comprises at least one of a phosphor and dye.

9. The device of claim 1, wherein the movable cover comprises at least one of a diffuser and lens.

10. The device of claim 1, wherein the controller is also connected to the one or more light sources and is configured to simultaneously provide operational instructions to the one or more light source and the active cooling element depending upon one or more inputs received at the controller.

11. An illumination system, comprising:

a controller in electrical communication with an active cooling element and configured to operate the active cooling element by switching the active cooling element between a first operational state and a second operational state; and a movable cover moveable between a first position and a second position depending upon the operational state of the active cooling element, wherein the movable cover alters at least one characteristic of light that passes therethrough.

12. The system of claim 11, wherein the movable cover is configured to be in the first position when the active cooling element is in the first operational state and wherein the movable cover is configured to be in the second position when the active cooling element is in the second operational state.

13. The system of claim 12, wherein the first operational state corresponds to an ON state and wherein the second operational state corresponds to at least one of an OFF and LOW state.

14. The system of claim 11, further comprising:

a shell having a window, the window having the movable cover positioned adjacent thereto, wherein the window is substantially covered by the movable cover when the movable cover is in the first position, and wherein the window is at least partially open when the movable cover is in the second position.

15. The system of claim 11, further comprising:

a light source configured to emit light of a first color, wherein the movable cover changes the light emitted by the light source to a second color.

16. The system of claim 15, wherein the active cooling element comprises a fan, wherein the controller is also configured to operate the light source synchronously with the operation of the active cooling element.

17. An illumination method, comprising:

creating a wind-based force with an active cooling element of an illumination device; and using the wind-based force to adjust a light converter of the illumination device, wherein the light converter comprises at least one movable cover that moves in response to the wind-based force.

18. The method of claim 17, wherein the at least one movable cover comprises at least one of a phosphor and dye and wherein the at least one movable cover rotates about a pivot element.

19. The method of claim 17, further comprising:

adjusting a position of the at least one movable cover by adjusting a magnitude of the wind-based force created by the active cooling element.

20. The method of claim 19, wherein the active cooling element adjusts the magnitude of the wind-based force in response to receiving an instruction to at least one of (i) change a color of light emitted by the illumination device and (ii) adjust a brightness of light emitted by the illumination device.

* * * * *